US006558815B1

(12) United States Patent
Suzuki et al.

(10) Patent No.: US 6,558,815 B1
(45) Date of Patent: May 6, 2003

(54) HOT DIP GALVANIZED STEEL PLATE EXCELLENT IN BALANCE OF STRENGTH AND DUCTILITY AND IN ADHESIVENESS BETWEEN STEEL AND PLATING LAYER

(75) Inventors: Yoshitsugu Suzuki, Okayama (JP); Chiaki Kato, Okayama (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/869,903

(22) PCT Filed: Nov. 8, 2000

(86) PCT No.: PCT/JP00/07836

§ 371 (c)(1),
(2), (4) Date: Oct. 30, 2001

(87) PCT Pub. No.: WO01/34862

PCT Pub. Date: May 17, 2001

(30) Foreign Application Priority Data

Nov. 8, 1999 (JP) ..... 11/316439
Jul. 14, 2000 (JP) ..... 2000-214713

(51) Int. Cl.[7] ..... B32B 15/18; B05D 3/00

(52) U.S. Cl. ..... 428/659; 148/533; 427/383.1; 427/383.7; 427/433; 427/436; 428/328; 428/329; 428/331; 428/939

(58) Field of Search ..... 428/659, 629, 428/632, 633, 939, 328, 329, 331; 148/533; 427/383.1, 383.7, 433, 436

(56) References Cited

U.S. PATENT DOCUMENTS 5,156,690 A * 10/1992 Asano et al. ..... 428/659

FOREIGN PATENT DOCUMENTS

| | | | | |
|---|---|---|---|---|
| GB | 1 342 120 | | 12/1973 | |
| JP | 55-131168 | | 10/1980 | |
| JP | 58-052433 | | 3/1983 | |
| JP | 02-290955 | A * | 11/1990 | ..... C23C/2/06 |
| JP | 4-072017 | | 3/1992 | |
| JP | 4-293730 | | 10/1992 | |
| JP | 5-51647 | | 3/1993 | |
| JP | 5-179356 | | 7/1993 | |
| JP | 06-330181 | A * | 11/1994 | ..... C21D/9/48 |
| JP | 09-176815 | A * | 7/1997 | ..... C23C/2/06 |
| JP | 2000-290730 | A * | 10/2000 | ..... C21D/9/46 |
| WO | WO 00/18976 | | 4/2000 | |
| WO | WO 00/50659 | | 8/2000 | |

* cited by examiner

*Primary Examiner*—Robert R. Koehler
(74) *Attorney, Agent, or Firm*—Young & Thompson

(57) ABSTRACT

The hot dip Zn galvanized steel sheet has excellent balance between tensile strength and ductility and excellent coating adhesion, an average composition of a base steel thereof includes: 0.05–0.25 mass % of C; not more than 2.0 mass % of Si; 1.0–2.5 mass % of Mn; and 0.005–0.10 mass % of Al, wherein the C content at the base steel surface layer portion right under a coating layer is not more than 0.02 mass %, the base steel structure contains not less than 50% of martensite phase, the martensite phase including both tempered martensite phase and fine size martensite phase, and the remaining portion of the base steel structure being formed by ferrite phase and residual austenite phase. A method of producing the hot dip Zn galvanizing steel sheet is described.

5 Claims, 2 Drawing Sheets

HOT DIP GALVANIZED STEEL PLATE EXCELLENT IN BALANCE OF STRENGTH AND DUCTILITY AND IN ADHESIVENESS BETWEEN STEEL AND PLATING LAYER

TECHNICAL FIELD

The present invention relates to a hot dip zinc-coated steel sheet having excellent tensile strength and ductility balance and excellent coating adhesion, which sufficiently endures a complicated press molding forming, and a method of producing the same.

The hot dip zinc-galvanized steel sheet of the present invention includes that which contains alloy elements such as Fe in the zinc coating layer thereof.

BACKGROUND ART

In general, hot-rolled steel sheet and cold-rolled steel sheet exhibit poorer ductility (i.e., poorer total elongation, bending property and the like) as the tensile strength thereof increases, whereby complicated press forming of the steel plate becomes difficult to perform.

It is also generally known that adding elements such as Mn, Si and the like for the purpose of increasing the tensile strength of the steel sheet solid solution strengthing and achieves an excellent composite-structure, which is advantageous for improving the balance between the tensile strength and elogation.

However, as Mn, Si and the like are elements which are easily oxidized, if such elements are added by a large amount, Si, Mn and the like segregated on the surface of the steel sheet during annealing, whereby the wetting property of the steel sheet with respect to molten zinc deteriorates, resulting in significantly poor reactivity between the base steel and the molten zinc.

In this case, the coating adhesion property deteriorates due to such poor reactivity, and exfoliation of coating what is called "powering" or "flaking" is generated during forming.

As a method of solving the aforementioned problems and producing a high tensile strength hot dip zinc-galvanized steel sheet having excellent formability, JP-A 5-179356 and JP-A 5-51647, Laid-Open, for example, disclose a method of: rapidly quenching-cooling the steel sheet during the hot rolling coiling process; annealing the steel sheet in the dual phase region in a hot dip Zn galvanizing line; and carrying out galvanizing.

However, in practice, if Si is added even by a very little amount, there arises a problem that the coating adhesion deteriorates and coating exfoliation of coating is likely to occur.

Therefore, it has conventionally been considered that production of a high tensile strength hot dip Zn galvanized steel sheet having excellent coating adhesion is impossible when a steel sheet containing relatively large amounts of Si, Mn and the like is used as the base material.

Further, the inventions of (1) PCT/JP99/04385; (2) PCT/JP97/00045; and (3) PCT/JP00/00975 disclose, respectively: (1) a coating method of a high tensile strength steel sheet containing Mo; (2) a coated steel sheet having an oxide layer in the base steel surface layer portion of a steel sheet; and (3) a coated steel sheet having an oxide layer produced by annealing a base steel having mill scale on the surface.

According to the invention (1) described above, a coated sheet having high tensile strength and excellent coating adhesion can be obtained. However, as the micro structure of the base material is not subjected to sufficient control, the desired ductility which is required in addition to the tensile strength cannot be obtained. Further, as the inner oxide layer is not subjected to any control, the resulting product of the invention (1) can only insufficiently meet the strict requirements, which have been demanded in recent years and are necessary for the present invention, for the balance between tensile strength and ductility and the coating adhesion.

In the invention (2) described above, high tensile strength can be obtained by appropriately selecting chemical compositions of the steel, and the resulting coating adhesion is also excellent. However, as the structure of the base material is not subjected to any control, as is the case in the aforementioned invention (1), the desirable ductility which is required in addition to the tensile strength cannot be obtained in the invention (2), either. Accordingly, the steel sheet of the invention (2) can only insufficiently meet the requirements in performances which are necessary in the present invention.

Further, in terms of quality control of coating, requirements in the coating adhesion property are now becoming more strict than before, due to more varied applications of a high tensile strength steel sheet, which is combined with the significant increase in use of such a steel sheet in recent years. Accordingly, it is becoming harder to satisfy the requirements in the coating adhesion property as described above by simply forming an internal oxide layer.

More specifically, such strict requirements as described above cannot be satisfied unless the compositions of the base steel right under the coating layer are also controlled, as disclosed in the present invention.

Further, in the invention (3) described above, high tensile strength is obtained by appropriately selecting the compositions of the steel, similarly to the aforementioned invention (2). However, as the structure of the base material is not subjected to any control, as is the case in the aforementioned invention (1), the desirable ductility which is required in addition to the tensile strength cannot be obtained in the invention (3), either. Accordingly, the steel sheet of the invention (3) can only insufficiently meet the requirements in performances which are necessary in the present invention.

The requirements for the coating adhesion property are now becoming more strict than before, as explained with respect to the invention (2). Such strict requirements cannot be satisfied in the invention (3), either, unless the compositions of the base steel right under the coating layer are also controlled as disclosed in the present invention.

DISCLOSURE OF THE INVENTION

The present invention has an object to solve the aforementioned problems of the prior art and provide, when the base steel sheet (i.e., the base steel) contains relatively large amounts of Si, Mn and the like, a high tensile strength hot dip Zn galvanized steel sheet having excellent coating adhesion and ductility, that is, a hot dip Zn galvanized steel sheet having excellent balance between tensile strength and ductility and excellent coating adhesion.

In addition, the present invention has another object to provide a method of advantageously producing the hot dip Zn galvanized steel sheet exhibiting excellent performances as described above.

Specifically, the structure of the present invention can be summarized as follows.

1. A hot dip Zn galvanized steel sheet having excellent balance between tensile strength and ductility and excellent coating adhesion, an average composition of a base steel thereof comprising:
   0.05–0.25 mass % of C;
   not more than 2.0 mass % of Si;
   1.0–2.5 mass % of Mn; and
   0.005–0.10 mass % of Al,
   wherein the C content at the base steel surface layer portion right under a coating layer is not more than 0.02 mass %, the base steel structure contains martensite phase, by not less than 50% as a fraction percentage, the martensite phase including both tempered martensite phase and fine size martensite phase, and the remaining portion of the base steel structure being formed by ferrite phase and residual austenite phase.
2. A hot dip Zn galvanized steel sheet having excellent balance between tensile strength and ductility and excellent coating adhesion of the aforementioned (1), wherein at least one type of oxide selected from the group consisting of Si oxides, Mn oxides, Fe oxides and composite oxides thereof is present, in at least one of grain boundary and crystal grain of a region in which the C content is not more than 0.02 mass % of the base steel surface layer portion right under the coating layer, and the amount of oxides generated on the base steel surface layer portion, when it is converted into the amount of oxygen, is 1–200 mass-ppm.
3. A hot dip Zn galvanized steel sheet having excellent balance between tensile strength and ductility and excellent coating adhesion of the aforementioned 1 or 2, wherein the Fe content of the coating layer is in the range of 8–12 mass %.
4. A method of producing a hot dip Zn galvanized steel sheet having excellent balance between tensile strength and ductility and excellent coating adhesion, comprising the steps of:
   preparing hot-rolled steel sheet or cold-rolled steel sheet having a steel sheet average composition which includes: 0.05–0.25 mass % of C; not more than 2.0 mass % of Si; 1.0–2.5 mass % of Mn; and 0.005–0.10 mass % of Al;
   heating the hot-rolled steel sheet or cold-rolled steel sheet in an atmosphere which satisfies the following formula at a temperature of 800–1000° C.:

$$\log(H_2O/H_2) \geqq 2.5[C]-3.5$$

wherein $H_2O/H_2$ represents the ratio of the partial pressure of moisture in the atmosphere with respect to the partial pressure of hydrogen gas, and [C] represents the amount of C in the steel (mass %).
5. A method of producing a hot dip Zn galvanized steel sheet having excellent balance between tensile strength and ductility and excellent coating adhesion of the aforementioned 4, further comprising the step of subjecting the steel sheet to galvannealing alloy process at a temperature of 450–550° C. after completing the hot dip Zn galvanizing process.

BEST MODE FOR CARRYING OUT THE INVENTION

Figure 1:
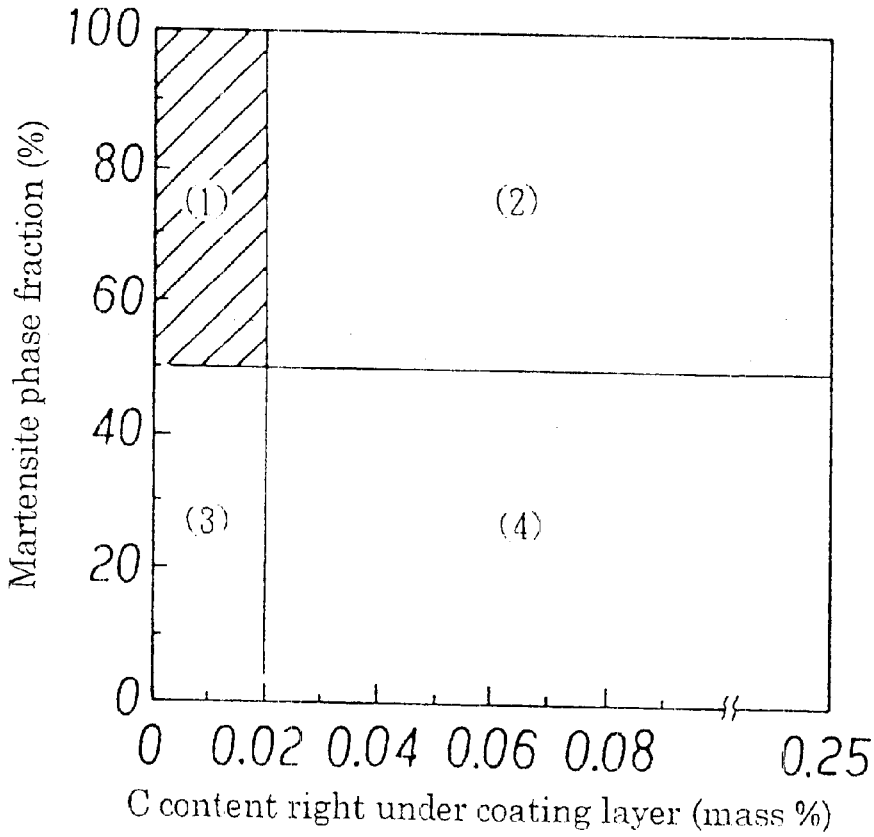
FIG. 1 is a figure which shows the influence caused by the C content right under the coating layer and the fractions of the martensite phase, on the balance between tensile strength and ductility and the coating adhesion property.

The experiment on which the present invention is based will be described hereafter.

A sheet bar having thickness of 30 mm and a composition which includes 0.15 mass % of C, 1.0 mass % of Si, 1.5 mass % of Mn, 0.01 mass % of P, 0.003 mass % of S, 0.04 mass % of Al, 0.002 mass % of N, 0.002 mass % of O was heated at 1200° C., whereby a hot-rolled steel sheet having thickness of 2.0 mm was produced by five passes. The produced steel sheet was coiling at 500° C.

Thereafter, after the mill scale-like oxides were removed by pickling, the steel sheet was annealed in an annealing furnace at 900° C. for 80 seconds and then rapidly cooled to 300° C. at the cooling rate of 10–80° C./s. The steel sheet was pickled with 5% hydrochloric acid at 60° C. for 10 seconds, so that the surface segregated products were removed.

Next, the steel sheet which had been pickled was annealed in a upright-type anneal galvanizing device at 750° C. for 20 seconds, and rapidly cooled to 470° C. at the cooling rate of 10–80° C./s. The steel sheet was then subjected to the galvanizing process for 1 second in a hot dip Zn galvanized bath in which the Al concentration was 0.15 mass % and the temperature of the bath was 465° C.

The hot dip Zn galvanized steel sheet obtained in such a manner was examined according to the methods described below, with respect to the mechanical property, the coating adhesion property, the C content of the base steel surface layer portion right under the coating layer, the structure right under the coating layer (the structure of the base steel surface layer portion) and the base steel structure (the internal structure) thereof.

(1) Mechanical Property of the Hot Dip Zn Galvanized Steel Sheet

The steel sheet having tensile strength (TS) of no lower than 590 MPa and elongation (El) of no smaller than 35% was evaluated as "excellent" and the steel sheet whose TS and El were beyond the aforementioned ranges was evaluated as "poor".

(2) Coating Adhesion Property

An adhesive tape was stacked on a hot dip Zn galvanized steel sheet and bent by 90° and then bent again in the opposite direction so that the steel sheet recovered the original shape, with making the side on which the adhesive tape had been stacked the bent (compressed) side. Thereafter, the adhesive tape was peeled off and the amount of the coating layer which adhered to the adhesive tape was evaluated by: measuring the Zn count number (κ) per unit length (m) of the adhesive tape after the fluorescent X ray illumination; and evaluating the steel sheets whose Zn count number belonged to rank 1 or 2 according to the criteria of Table 1 as "excellent" and those whose Zn count number belonged to rank 3 or lower according to the criteria of Table 1 as "poor".

TABLE 1

| Zn count number after fluorescent X ray illumination: κ | Rank |
|---|---|
| $0 \leqq \kappa < 500$ | 1 (excellent) |
| $500 \leqq \kappa < 1000$ | 2 (excellent) |
| $1000 \leqq \kappa < 2000$ | 3 (poor) |
| $2000 \leqq \kappa < 3000$ | 4 (poor) |
| $3000 \leqq \kappa$ | 5 (poor) |

(3) Method of Determining the C Content at the Base Steel Surface Layer Portion Right Under the Coating Layer A mixed solution was prepared by adding 35 mass % $H_2O_2$ aqueous solution to 8 mass % NaOH aqueous solution by the ratio of 4:100 (volume). The 8 mass % NaOH aqueous solution contained 2 mass % of triethanolamine which had been added thereto as an inhibitor. By using this mixed solution, only the coating layer (including both the Fe—Zn alloy layer and the Fe—Al alloy layer) was dissolved and removed.

Next, by using 5 mass % HCl aqueous solution at 60° C., the base steel surface layer portion was dissolved by 5 μm depthwise, according to the weighing method in which the amount of lost or dissolved portion of the base steel surface layer portion was estimated by using, as indexes, the weight of the steel sheet before/after pickling.

The solution resulted from the dissolving processes described above was subjected to the evaporation process to obtain dry solids. The amount of C in the obtained dry solids was determined by using the combustion-infrared absorption method as prescribed in the JIS regulations (G1211), and the C content at the base steel surface layer portion right under the coating layer was obtained on the basis of the results of the determination.

(4) The Base Steel Structure, the Fraction Percentage of the Martensite Phase

The section of the steel plate embedded in a resin was etched by using a nital solution which is a liquid that etches grain boundary.

Next, the ferrite phase was observed with an electron microscope at the magnification of ×1000.

[Nital Solution]

(The mixture of 69 mass % $HNO_3$ aqueous solution and ethanol by the ratio of 3:97 (vol. %))

With respect to the martensite phase, the volume fraction of the martensite phase Was obtained by: grinding the sample again to remove the etching layer after the aforementioned etching process by the nital solution; etching the sample by using the martensite etching solution described below; observing the sample with an electron microscope at the magnification of ×1000; obtaining, by analyzing the image resulted from the electron microscope observation, the area rate occupied by the martensite phase which was present within the square area (100 mm×100 mm).

[Martensite Etching Solution]

(A picral solution (4 g of picric acid/100 cc of ethanol) containing 1 mass % sodium pyrosulfite)

The observation region of the martensite phase, the ferrite phase and the austenite phase was set at an average position in the sheet thickness direction. It should be noted that the surface layer (50 μm from the surface) and the outer, disturbed portion (such as the center segregation) were avoided.

The amount of residual austenite was obtained by: taking a testing piece from the steel sheet; grinding the testing piece to the center surface in the sheet thickness direction; and measuring the diffraction X ray intensity at the center surface in the sheet thickness direction. As the incident X ray, MoK α ray was employed. The ratio of the diffraction X ray intensity was calculated for each surface {111}, {200}, {220} and {311} of the residual austenite phase of the testing piece, and the volume fraction of the residual austenite was obtained as the average value of these ratios.

The obtained results are summarized in FIG. 1.

As shown in FIG. 1, a hot dip Zn galvanized steel sheet having excellent balance between tensile strength and ductility and excellent coating adhesion was obtained when the C content at the base steel surface layer portion right under the coating layer was not more than 0.02 mass % and the partial percentage of the martensite phase in the base steel structure is not less than 50% (Area 1).

The base steel structure other than the martensite phase was constituted of the second phase which included the ferrite phase and the residual austenite phase.

On the other hand, when the steel sheets did not satisfy the aforementioned range of the C content and the fraction of the martensite phase, at least one of the balance between tensile strength and ductility and the coating adhesion ended up the poor result. A hot dip Zn galvanized steel sheet within Area 2 of FIG. 1 had excellent balance between tensile strength and ductility, but poor coating adhesion. A hot dip Zn galvanized steel sheet within Area 3 of FIG. 1 had excellent coating adhesion but poor balance between tensile strength and ductility. A hot dip Zn galvanized steel sheet within Area 4 of FIG. 1 had both poor balance between tensile strength and ductility and poor coating adhesion.

In the present invention, on the basis of the knowledge described above, the C content at the base steel surface layer portion right under the coating layer was restricted to be not more than 0.02 mass % and, with respect to the base steel structure, the structure is restricted to that which contains: the martensite phase by the fraction of not less than 50%; and the second phase, which included the ferrite phase and the residual austenite phase.

Next, the reason why the composition range of the components of the base material steel sheet (the base steel) of the present invention are restricted to the aforementioned ranges will be described.

C: 0.05–0.25 Mass %

Carbon is an essential element for obtaining necessary tensile strength and making the final structure a composite structure of tempered martensite and fine size martensite which exhibits excellent formability. The C content in the steel should be restricted to be not less than 0.05 mass %.

However, when the C content in the steel exceeds 0.25 mass %, not only the welding property deteriorates but also the hardenability property at the cooling after annealing in a continuous-type hot dip Zn galvanizing line (which will be referred to as "CGL" hereinafter) deteriorates, whereby the desired composite structure is hardly to be obtained.

In short, in the present invention, it is essential to obtain the desired composite structure by quenching after CGL annealing.

The temperature of the sheet which is dipped in the galvanizing bath is in the range of 450–500° C., as described below, and the desired composite structure must be formed before the temperature reaches 600° C. which is the upper limit of the controlling range for stop cooling temperature. Therefore, it is essentially required that the excellent hardenability property is ensured and the desired composite structure is reliably formed.

Accordingly, due to the aforementioned reason, the C content in the steel is restricted within the range of 0.05–0.25 mass %.

Si: Not More than 2.0 Mass %

Silicon enhances solid solution hardening and formation of an excellent composite structure, advantageously improves the balance between tensile strength and elongation, and thus is an element which is useful for improving the formability.

However, when the Si content in the steel exceeds 2.0 mass %, the coating adhesion deteriorates. Thus, the upper limit of the Si content in the steel is set at 2.0 mass % in the present invention.

In addition, it is preferable that the lower limit of the Si content in the steel is set at 0.1 mass % in terms of achieving a better balance between tensile strength and ductility.

Specifically, in the present invention, it is more preferable that the Si content in the steel is set within the range of 0.1–2.0 mass %.

Mn: 1.0–2.5 Mass %

Manganese is an element which is not only useful for obtaining the necessary tensile strength and the desired composite structure but also important for ensuring the excellent hardenability property after the CGL annealing process, the same as carbon is.

When the Mn content in the steel is less than 1.0 mass %, the effect of adding Mn is hardly observed. On the other hand, when the Mn content in the steel exceeds 2.5 mass %, the welding property of the steel deteriorates.

Accordingly, the Mn content in the steel is restricted within the range of 1.0–2.5 mass %.

Al: 0.005–0.10 Mass %

Aluminum is an element which is useful for enhancing the index of cleanness steel due to the deoxidizing action thereof. However, when the Al content in the steel is less than 0.005 mass %, the effect of adding Mn is hardly observed. On the contrary, when the Al content in the steel exceeds 0.10 mass %, the effect of addition of Al saturates rather causing deterioration of elongation property of the steel.

Accordingly, the Al content in the steel is restricted within the range of 0.005–0.10 mass %.

In the present invention, when each of the C, Si, Mn and Al contents satisfies the predetermined range described above, the desired effect can basically be obtained.

Further, in the present invention, the elements described below may be added properly, according to necessity, in order to further improve the material properties.

At Least One Type of Element Selected from the Group Consisting of 0.005–0.10 Mass % of Nb and 0.01–0.20 Mass % of Ti Both Nb and Ti are the elements which enhance precipitation hardening. By using an appropriate amount of Nb and/or Ti, the tensile strength of the steel can be improved without deteriorating the welding property thereof.

However, when the added amount of Nb and/or Ti is less than the lower limit described above, the effect of addition thereof is hardly observed.

On the other hand, when the added amount of Nb and/or Ti exceeds the upper limit described above, the effect reaches the saturated stage.

Accordingly, it is preferable that at least one type of element selected from Nb and Ti is contained in the steel within the range described above.

One Type or at Least Two Types of Elements Selected from the Group Consisting of Cr, Ni and Mo (the Total Amount Thereof is to be within the Range of 0.10–1.0 Mass %)

Cr, Ni and Mo are elements each of which enhances the hardenability property. By using an appropriate amount of these elements, the ratio of martensite in the annealing in a continuous annealing line (which will be referred to as "CAL" hereinafter) and cooling is increased and the lath structure of the martensite is made fine-sized.

Accordingly, by adding one type or at least two types of elements selected from Cr, Ni and Mo, the hardenability property in the re-heating process of the dual-phase region in the next CGL annealing process to the cooling process becomes excellent and the final composite structure after the cooling becomes excellent, whereby the molding formability is improved in various manners.

In order to obtain such an effect, it is preferable that one type or at least two types of elements selected from Cr, Ni and Mo is added so that the total added amount of these elements is at least 0.10 mass %.

However, as these elements are all quite expensive, in terms of reducing production costs, it is preferable that the upper limit of the total added amount of these elements is set at 1.0 mass %.

With respect to impurity components, the following points are to be noted.

P (phosphorus) and S (sulfur) are both likely to enhance segregation and increase the amount of non-metal inclusions, thereby adversely influencing the formability of the steel in various manners. Accordingly, it is preferable to reduce the amount of P and S as best as possible.

However, the presence of P at 0.015 mass % or less, and the presence of S at 0.010 mass % or less are acceptable.

In terms of reducing the production costs, the preferable lower limit of the P content is 0.001 mass % and that of the S content is 0.0005 mass %.

Next, the steel (base steel) structure of the hot dip Zn galvanized steel sheet of the present invention and the preferable conditions in producing this base steel structure will be described.

Slabs having thickness of 300 mm or so produced by the continuous casting process are heated to 1200° C., rolled by hot rolling so as to have thickness of 2.3 mm or so, and coiled at the temperature of approximately 500° C., thereby resulting in hot rolled steel plates.

As described below, as the rapid cooling process is carried out in the continuous annealing line (CAL), the base material steel sheet may be either a hot-rolled steel sheet or a cold-rolled steel sheet.

Accordingly, cold rolling may optionally be carried out so that the sheet thickness can be adjusted in accordance with the type of the final application of the steel. Since such a rolling process at the aforementioned stage hardly affects the steel as long as the production conditions at the subsequent steps are set as required, the reduction ratio is not need to be restricted in any particular manner.

Base Steel Structure

According to the present invention, by forming the base steel structure so as to have the tempered martensite phase and the fine size martensite phase as main phases, excellent mechanical property can be obtained.

The reason for why such an excellent mechanical property can be obtained is as follows.

The tempered martensite phase, as a soft phase, serves to deformation at the initial stage of the forming.

On the other hand, the fine size martensite phase as a hard phase has much higher deformability than the tempered martensite phase. Therefore, when the soft phase has been hardened by work hardening so as to have the substantially the same tensile strength as that of the fine size martensite, the hard martensite phase also begins to serve to deformation.

Due to this, at the subsequent stages, the soft phase and the hard phase as a whole contribute to deformation. Further, it should be noted that the hard phase does not act as the void core. As a result, the breaking-deformation time is delayed and thus excellent formability can be achieved.

The larger the fraction of the two martensite phases in the base steel structure is, the more excellently the effect described above is achieved.

Therefore, in the present invention, the fraction of the two martensite phases in the base steel structure is prescribed, as the total of the two martensite phases, to be not less than 50%.

Note that the aforementioned fine size martensite phase represents a martensite phase in which the grain diameter is not larger than 5 μm.

Further, the total of the fraction of the aforementioned two martensite phases can be obtained, as described above, by: etching a section of the steel plate embedded in a resin; observing the etched surface with an electron microscope; and measuring the rate of the area occupied by the martensite phase by analyzing the image resulted from the observation with the electron microscope.

Examples of a method of obtaining such a structure of the base steel include a method of annealing the sample in CAL at the temperature of 800–1000° C., and then cooling the sample rapidly at a cooling rate of 40° C./s or higher so that the temperature of the sample after cooling becomes not higher than 300° C.

The remaining portion of the structure (other than the aforementioned two main martensite phases) are constituted of the ferrite phase and the residual austenite phase, because a composite structure containing the ferrite phase and the residual austenite phase significantly contributes to the improvement of other mechanical properties (e.g., decreasing the yielding ratio). Such a characteristic cannot be observed in a composite structure containing bainite, pearlite and the like.

Accordingly, the second phase, which does not include the martensite phase, is constituted of the ferrite phase and the residual austenite phase.

Further, the aforementioned structure of the base steel is formed by: re-heating the steel sheet in CGL after the CAL annealing process within a temperature range of 700–850° C., preferably of 725–840° C.; cooling the steel sheet at a cooling rate of 2° C./s or more so that the temperature of the steel sheet after cooling becomes no higher than 600° C.; and thereby generating a fine size austenite phase in the lath portion of the portions where the structure thereof was originally martensite.

The C (carbon) content of the base steel surface layer portion right under the coating layer The base steel surface layer portion right under the coating layer described above represents a region of the base steel, ranging from the surface thereof from which the coating layer has been removed, to the 5 μm depth in the depth direction (i.e., a region within 5 μm in the depthwise direction from the base steel surface). This region is supposed to be involved with the galvannealing reaction in galvannealing, which is performed, according to necessity, during in galvanizing or thereafter.

When the C content at the base steel surface layer portion right under the coating layer exceeds 0.02 mass %, the carbon which cannot be solid-solved appears as precipitates like cementite ($Fe_3C$), and such preciptates disturb the reaction between the base steel and Zn in galvannealing which is optionally carried out during galvanizing or after galvanizing, whereby the coating adhesion is adversely affected.

On the other hand, when the C content at the base steel surface layer portion right under the coating layer is not more than 0.02 mass %, the aforementioned precipitates are not generated. Therefore, even in the case of a high C content steel sheet whose average C content in the base steel is not more than 0.05 mass %, the coating adhesion is presumably still improved to an excellent state.

Methods of decreasing the C content only at the base steel surface layer portion, as described above, are not subjected to any restriction. One example thereof is a method of decarbonizing the surface layer portion by annealing a steel sheet in an atmosphere whose dew point is relatively high.

The C content in the steel right under the coating layer (the C content at the base steel surface layer portion) can be measured by any of the following methods (1)–(3) or other suitable methods.

(1) Only the coating layer (including both the Fe—Zn alloy layer and the Fe—Al alloy layer) is removed by dissolving the layer with an alkali solution containing an inhibitor described below. Thereafter, the front and back surfaces of the base steel are dissolved 5 μm depthwise, by using 5 mass % HCl aqueous solution at 60° C., according to the weighing method in which the amount of decreased thickness at the base steel surface layer portion is estimated by using as indexes the weight of the steel sheet before/after pickling.

Next, the solution resulted from the aforementioned dissolving process is subjected to the evaporation process to obtain dry solids. The amount of C in the obtained dry solids is determined by using the combustion-infrared absorption method as prescribed in the JIS regulations (G1211).

[Alkali Solution Containing an Inhibitor]

A mixed solution prepared by adding 35 mass % $H_2O_2$ aqueous solution to 8 mass % NaOH aqueous solution (containing 2 mass % of triethanolamine) by the ratio of 4:100 (volume)

(2) The section of the base steel surface layer is analyzed by an analytic device such as the electron probe X ray micro analyzer (EPMA) for determining the C content.

(3) Only the base steel surface layer portion is electrochemically dissolved and the C content of the obtained solution is determined.

In the examples of the present invention described below, the aforementioned method (1) was employed.

Presence/absence of cementite precipitates can be easily determined by etching the section of the steel sheet and observing the etched surface with an optical microscope or an electron microscope.

Further, in the aforementioned region of the base steel surface layer portion in which the C content is not more than 0.02 mass %, if oxides containing Si, Mn, Fe (i.e., the elements present in the steel), specifically, Si oxides, Mn oxides, Fe oxides, composite oxides thereof or oxides containing at least one type of oxide selected from the aforementioned oxides, exist in at least one of the grain boundary and the crystal grain, the stress is relaxed because fine cracks are introduced to the interface between the coating layer and the base steel during the bending process of the coating film.

As a result, an effect in which the coating adhesion is significantly improved is achieved.

On the other hand, when the C content of the base steel surface layer portion right under the coating layer exceeds 0.02 mass % and the precipitates like cementite ($Fe_3C$) are present, the effect of improving the coating adhesion is poor.

The effect of improving the coating adhesion property is poor in the latter case, probably because cementite prevents cracks from being introduced.

Accordingly, in order to achieve an excellent effect of improving the coating adhesion property, it is preferable that, in a region of the base steel surface layer portion right under the coating layer in which the C content is not more than 0.02 mass %, the aforementioned various oxides containing Si, Mn, Fe (i.e., the elements present in the steel) are present in at least one of the grain boundary and the crystal grain.

In the present invention, presence/absence of oxides generated at the base steel surface layer portion can be checked by etching a section of the steel sheet with a picral solution (4 g of picric acid/100 cc of ethanol) and observing the etched surface by a scanning electron microscope (SEM). In this case, if an oxide layer having thickness of 0.1 $\mu$m or more has been generated in at least one of the grain boundary and crystal grain, that fact indicates that "an oxide layer has been generated".

The type of the oxide can be determined by analyzing the extracts according to the Inductively Coupled Plasma Atomic Emission Spectrometry.

The amount of oxides generated at the base steel surface layer portion described above is, when the amount of oxides is converted into the amount of oxygen, preferably 1–200 mass-ppm.

The reason for the aforementioned restriction of the amount of oxides is as follows. If the amount of the generated oxides, when converted into the amount of oxygen, is less than 1 mass-ppm, the effect of improving the coating adhesion will not be sufficient because the amount of the generated oxides is too small. On the other hand, if the amount of the generated oxides, when converted into the amount of oxygen, exceeds 200 mass-ppm, the amount of the generated oxides is too large and the coating adhesion will rather deteriorate.

Here, the amount of oxides generated at the base steel surface layer portion is converted into the amount of oxygen by: measuring the amount of oxygen of the steel sheet whose coating layer has been separated and removed with an alkali aqueous solution containing the inhibitor, according to the inert gas melt infrared absorption method; measuring the amount of oxygen of the steel plate produced by grinding, by a mechanical method, about 100 $\mu$m of the front and back surfaces of the steel sheet whose coating layer has been separated and removed, according to the inert gas melt infrared absorption method; and calculating the difference between the two amounts of oxygen.

Heating Process (Annealing)

Hot-rolled steel sheet or cold-rolled steel sheet must be heated to 800–1000° C.

The reason for this is as follows. When the heating temperature is lower than 800° C., the excellent coating adhesion will not be obtained due to the insufficient decarbonizing reaction. On the other hand, if the heating temperature exceeds 1000° C., the furnace will be significantly damaged.

Further, the concentration of hydrogen in the atmosphere during the heating process (annealing) is preferably in the range of 1–100 vol. %.

This is because, when the hydrogen concentration is less than 1 vol. %, the iron at the surface of the steel plate is oxidized and the coating property thereof is likely to deteriorate.

Yet further, it is necessary that the steel sheet is heated under an atmosphere condition which satisfies the following formula.

$$\log(H_2O/H_2) \geqq 2.5[C]-3.5$$

Here, $H_2O/H_2$ represents the ratio of the partial pressure of moisture in the atmosphere with respect to the partial pressure of hydrogen gas, and [C] represents the amount of C in the steel (mass %).

In order to obtain excellent coating adhesion, the surface layer portion must be decarbonized. When the amount of C increases, the amount of consumed O (oxygen) is also increased accordingly. That is, in order to achieve sufficient decarbonization, it is necessary that the $H_2O/H_2$ ratio in the atmosphere in the annealing furnace is increased.

Further, CO which is generated during decarbonization simultaneously enhances the internal oxidizing reaction, whereby generation of oxides in grain boundary and crystal grain is enhanced.

Accordingly, it is important that heating is performed under a condition which satisfies the range of the aforementioned formula.

After the annealing by the heating process described above, the steel sheet is cooled, and the surface of the steel plate is pickled so that the oxide thereon is removed, in a condition in which the decrease in the weight of the steel sheet due to the pickling is, when it is converted into the weight of Fe, 0.05–5 g/m$^2$.

The reason why the decrease in the weight of the steel sheet due to the pickling is restricted to the aforementioned range is as follows. If the decrease in the weight of the steel sheet due to the pickling, when converted into the amount of Fe, is less than 0.05 g/m$^2$, the pickling is insufficient and too much oxides remain, whereby the coating adhesion deteriorates. On the other hand, if the decrease in the weight of the steel sheet due to the picking, when converted into the amount of Fe, exceeds 5 g/m$^2$, the surface of the steel sheet becomes rough, the appearance of the steel sheet after hot dip Zn galvanizing is significantly marred, and in an extreme case, the internal oxidized layer and the decarbonized layer are also removed.

Due to this, the decrease in the weight of the steel sheet due to the pickling, when converted into the amount of Fe, is set to be in the range of 0.05–5 g/m$^2$, by adjusting, according to necessity, the concentration of the acid, the temperature of the pickling acid and the like in pickling.

The aforementioned decrease in the amount of the steel sheet due to pickling, when converted into the amount of Fe, can be obtained from the weight of the steel sheet before/after pickling.

As the acid used for pickling, hydrochloric acid is especially preferable. However, other acids such as sulfuric acid, nitric acid, phosphoric acid and the like are also acceptable. Any of these acids may be used in combination with hydrochloric acid. In short, there is no particular restriction on the types of acids.

Conditions of Hot Dip Zn Galvanizing

By subjecting the steel sheet prepared in the aforementioned manner to the coating treatment in the hot dip Zn galvanizing line, a hot dip galvanized steel sheet having excellent balance between tensile strength and ductility and excellent coating adhesion can be obtained.

Specifically, after the steel sheet is heated again to a temperature of 700–850° C. in a reducing atmosphere in the continuous-type hot dip Zn galvanizing line (CGL), the steel sheet is subjected to the hot dip galvanizing process.

When the heating temperature is lower than 700° C., reduction of the oxides generated on the surface of the steel sheet as the result of the pickling tends to be insufficient, whereby the coating adhesion property deteriorates. On the other hand, when the heating temperature exceeds 850° C., Si is again segregated on the surface of the steel sheet, whereby the coating adhesion inevitably deteriorates.

With respect to the hot dip Zn galvanizing coating bath, the hot dip Zn galvanizing coating bath which contains 0.08–0.2 mass % of Al is preferable. The temperature of the bath is preferably in the range of 450–500° C.

The temperature of the steel sheet when the steel sheet is immersed in the bath is preferably in the range of 450–500° C.

In addition, the amount of coating of the hot dip Zn galvanized steel sheet, per one surface of the steel plate or per unit area having coating thereon is, preferably 20–120 $g/m^2$.

When the aforementioned amount of the coating is less than 20 $g/m^2$, the anticorrosion resistance property of the steel sheet deteriorates. On the other hand, when the amount of the coating exceeds 120 $g/m^2$, the effect of improving the corrosion resistance property substantially saturates and uneconomical.

The hot dip Zn galvanized steel sheet thus obtained may be subjected to the heating process for producing galvannealed, according to necessity.

Such heating for producing alloy is preferable because it particularly improves the welding property. This process is modified to two types, one that includes heating for galvanizing and the other that lacks such heating, depending on how the steel sheet is used in practice.

The heating for galvanizing is preferably carried out within the temperature range of 450–550° C., and more preferably within the temperature range of 480–520° C.

The reason for setting the aforementioned ranges is as follows. When the temperature in galvannealing is lower than 450° C., the galvannealing reaction hardly proceeds. On the other hand, when the temperature in galvannealing exceeds 550° C., the galvannealing reaction proceeds excessively, whereby the coating adhesion property deteriorates and pearlite is produced, and the desired structure cannot be obtained.

Further, the amount of Fe diffused into the coating layer after galvannealing process, i.e., the Fe content in the coating layer is preferably restricted within the range of 8–12 mass %.

When the amount of the diffused Fe is less than 8 mass %, not only soft spots may be generated but also the sliding property of the steel sheet deteriorates because the galvannealing has not been carried out in a sufficient manner. On the other hand, when the amount of the diffused Fe exceeds 12 mass %, the coating adhesion rather deteriorates due to excessive alloy.

The amount of Fe diffused into the coating layer after the galvannealing process, i.e., the Fe content in the coating layer is more preferably within the range of 9–10 mass %.

Examples of a method of heating the steel sheet for galvannealing includes the conventionally known method in which a gas heating furnace, an induction furnace or the like is used.

EXAMPLES

The present invention will be described further in detail on the basis of the following examples.

A slab produced by the continuous casting process, having thickness of 300 mm and the component composition as shown in Table 2, was heated to 1200° C. and subjected to hot rolling so as to become a hot-rolled steel sheet having thickness of 2.3 mm. The resulting steel sheet was coiled at 500° C.

Next, the mill scale was removed by pickling. In examples Nos. 1 and 3, the steel sheet as a hot-rolled steel sheet was passed through a continuous annealing line (CAL) for heating, and then cooled. In examples Nos. 2, 4–25, the steel sheet was subjected to cold rolling at the reduction of 50%, and then passed through a continuous annealing line (CAL) for heating, and cooled.

Note that Table 3-1 shows the annealing temperature and the annealing atmosphere in the CAL, as well as the cooling condition after the annealing.

Next, the steel sheet after the annealing process was pickled aqueous hydrochloric acid solution, with adjusting the decrease in the weight of the steel plate due to the pickling at the appropriate level.

The adjustment of the decrease in the weight of the steel sheet due to the pickling was carried out by adjusting the concentration of HCl in the pickling solution within the range of 3–10 mass % and adjusting the temperature of the pickling solution within the range of 50–80° C.

Table 3-2 shows the aforementioned decrease in the weight of the steel sheet due to the pickling, as a value converted into the amount of Fe.

The aforementioned decrease in weight of the steel plate due to the pickling, when converted into the amount of Fe, was obtained from the weight of the steel plate before/after the pickling.

Next, the steel sheet, which had been pickled, was passed through the continuous-type hot dip Zn galvanizing line (CGL) for heat-reducing the steel sheet in a reducing atmosphere in which the hydrogen concentration was 5 vol. %. After the steel sheet was cooled, the steel sheet was subjected to the hot dip Zn galvanizing process.

Table 3-2 shows the heating temperature in the CGL and the cooling condition after the heat-reduction.

Further, the condition of the hot dip Zn galvanized process are shown below and Table 3-2.

The amount of the Zn coating of the hot dip Zn galvanizing steel sheet was set at 40 $g/m^2$ per unit area having coating thereon, in both surfaces of the steel sheet.

Further, in examples Nos. 1, 2 and examples Nos. 4–25, the heating process for galvannealying was carried out under the conditions described above, after the hot dip Zn galvanizing was provided.

(Conditions of the hot dip Zn galvanizing)

| | |
|---|---|
| Temperature of the steel sheet when it was immersed hot dip Zn galvanizing bath | 460–470° C. |
| Bath temperature of the hot dip Zn galvanizing bath | 460° C. |
| Al content of the hot dip Zn galvanizing bath | 0.13 mass % |
| Rate at which the steel sheet was passed through the bath (Conditions of the galvannealing) | 80–120 m/min |
| Temperature for galvannealing (temperature of the sheet) | 490–600° C. |
| Time spent for galvannealing | 20s |

Next, with respect to each of the hot dip Zn galvanizing steel sheet or the hot dip galvannealed steel sheet, (1) the C content at the base steel surface layer portion right under the coating layer; (2) the base steel structure and the fraction of the martensite phase in the base steel structure (i.e., the total of the fraction of the tempered martensite phase and the fraction of the fine size martensite phase); and (3) the amount of oxides generated at the base steel surface layer portion (which amount has been converted into the amount of oxygen) were measured or observed, respectively, as describe above.

(1) The C Content at the Base Steel Surface Layer Portion Right Under the Coating Layer The C content at the base steel surface layer portion right under the coating layer was determined by using an alkali solution containing an inhibitor and 5 mass % HCl at 60° C., according to the combustion-infrared absorption method, as described above.

The thickness of the base steel surface layer portion which was removed by dissolution was 5 μm.

(2)The Base Steel Structure and the Fraction of the Martensite Phase in the Base Steel Structure The base steel structure and the fraction of the martensite phase in the base steel structure were analyzed according to the aforementioned method of observing/measuring them.

(3) The Amount of Oxides Generated at the Base Steel Surface Layer Portion (Expressed as a Value Converted into the Amount of Oxygen)

The amount of oxides generated at the base steel surface layer portion (which amount has been converted into the amount of oxygen) was obtained by: measuring the amount of oxygen of the steel sheet whose coating layer had been separated and removed with an alkali aqueous solution containing the inhibitor, according to the inactive gas melt infrared absorption method (JIS Z 2613); measuring the amount of oxygen of the steel sheet produced by grinding, by a mechanical method, about 100 μm of the surfaces of the steel sheet whose coating layer had been separated and removed, according to the inactive gas melt infrared absorption method (JIS Z 2613); and calculating the difference between the two amounts of oxygen.

[Alkali Solution Containing an Inhibitor]

An aqueous solution prepared by adding 35 mass % $H_2O_2$ aqueous solution to 8 mass % NaOH aqueous solution (containing 2 mass % of triethanolamine) by the ratio of 4:100 (volume).

It should be noted that the "oxides" in the aforementioned amount of the generated oxides (which amount has been converted into the amount of oxygen) represent Si oxides, Mn oxides, Fe oxides or composite oxides thereof, and the "amount of generated oxides" represents the total amount (which amount has been converted into the amount of oxygen) of such various oxides.

When the oxides were analyzed, a section of the steel sheet embedded in a resin was etched with a picral solution (4 g of picric acid/100 cc of ethanol) and the locations at which the grain boundary and the crystal grain existed were observed.

In addition, with respect to the hot dip Zn galvanized steel sheet or the hot dip galvannealed, which was obtained in the aforementioned manner, the mechanical property and the coating adhesion property were investigated.

In evaluating the mechanical property, the steel sheet which satisfied the conditions: TS≧590 MPa and El≧35% was evaluated as "excellent" and the steel plate which did not satisfy the aforementioned conditions was evaluated as "poor".

Further, the coating adhesion property was evaluated by: stacking a adhesive tape on a hot dip Zn galvanized steel sheet; bending the plated steel sheet by 90° and then bending again in the opposite direction so that the steel sheet recovered the original shape; removing the coating layer on the compressed side by peeling the adhesive tape off; measuring the amount of the coating layer which adhered to the adhesive tape by measuring the Zn count number (κ) per unit length (m) of the adhesive tape after the fluorescent X ray illumination; and evaluating the result according to the criteria of Table 1 described above.

Table 4 shows the various properties of the coated steel sheet obtained in the aforementioned manner, including the mechanical property and the coating adhesion property.

Figure 2:
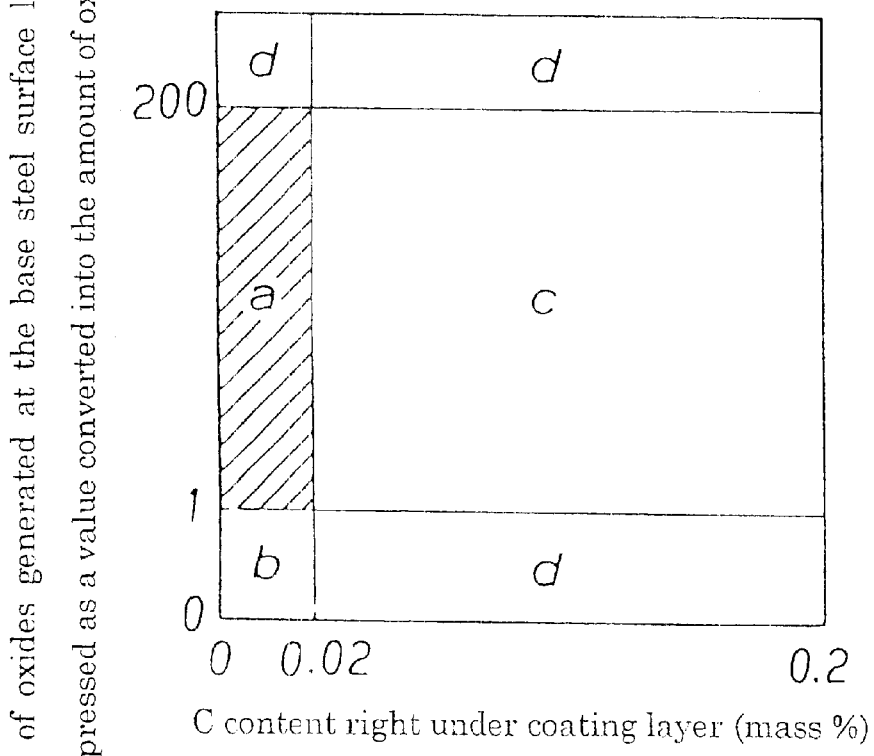
FIG. 2 is a figure which shows the influence caused by the C content right under the coating layer and the amount of oxides generated at the base steel surface layer portion (expressed as a value converted into the amount of oxygen), on the coating adhesion property.

In addition, FIG. 2 shows the influence caused by the C content at the base steel surface layer portion right under the coating layer and the amount of oxides generated at the base steel surface layer portion (which amount has been converted into the amount of oxygen), on the coating adhesion.

As is obviously known from Table 4, the steel sheet of the examples according to the present invention did not have any problems in either the mechanical property or the coating adhesion property. On the other hand, in the steel sheet of the comparative examples, at least one of the mechanical property and the coating adhesion property was significantly poor.

Further, as shown in FIG. 2, when the C content of the base steel surface layer portion right under the coating layer exceeds 0.02 mass %, the coating adhesion property deteriorates (Areas c and d). A hot dip Zn galvanized steel sheet within Area c of FIG. 2 had slightly poor coating adhesion. Hot dip Zn galvanized steel sheets within Area d of FIG. 2 had poor coating adhesion. Hot dip Zn galvanized steel sheets with a C content of the base steel surface portion right under the coating layer not more than 0.02 mass % and the amount of oxides generated at the base steel surface layer portion, as a value converted into the amount of oxygen, outside the range of 1–200 mass-ppm, within Area b of FIG. 2 had slightly excellent coating adhesion while those within Area d of FIG. 2 had poor coating adhesion. On the other hand, when the aforementioned C content is not more than 0.02 mass % and the amount of oxides generated at the base steel surface layer portion, as a value converted into the amount of oxygen, is in the range of 1–200 mass-ppm, the particularly excellent coating adhesion property can be obtained (Area a).

TABLE 2

| Example | Continuous casting slab composition (mass %) | | | | | | |
|---|---|---|---|---|---|---|---|
| No. | C | Si | Mn | P | S | Al | Others |
| 1 | 0.15 | 0.5 | 1.5 | 0.01 | 0.003 | 0.03 | — |
| 2 | 0.08 | 1.0 | 1.5 | 0.01 | 0.003 | 0.03 | — |
| 3 | 0.10 | 1.5 | 1.5 | 0.01 | 0.003 | 0.03 | — |
| 4 | 0.15 | 2.0 | 1.5 | 0.01 | 0.003 | 0.03 | — |
| 5 | 0.15 | 1.0 | 1.5 | 0.01 | 0.003 | 0.03 | Cr: 0.01 |
| 6 | 0.15 | 1.0 | 1.5 | 0.01 | 0.003 | 0.03 | Mo: 0.1 |
| 7 | 0.15 | 1.0 | 1.5 | 0.01 | 0.003 | 0.03 | Nb: 0.01 |
| 8 | 0.15 | 1.0 | 1.5 | 0.01 | 0.003 | 0.03 | Nb: 0.01 Ti: 0.02 |
| 9 | 0.15 | 1.0 | 1.5 | 0.01 | 0.003 | 0.03 | — |
| 10 | 0.03 | 1.0 | 1.5 | 0.01 | 0.003 | 0.03 | — |
| 11 | 0.15 | 2.5 | 1.5 | 0.01 | 0.003 | 0.03 | — |
| 12 | 0.15 | 1.0 | 0.5 | 0.01 | 0.003 | 0.03 | — |
| 13 | 0.15 | 1.0 | 1.5 | 0.01 | 0.003 | 0.03 | — |
| 14 | 0.15 | 1.0 | 1.5 | 0.01 | 0.003 | 0.03 | — |
| 15 | 0.15 | 1.0 | 1.5 | 0.01 | 0.003 | 0.03 | — |
| 16 | 0.15 | 1.0 | 1.5 | 0.01 | 0.003 | 0.03 | — |
| 17 | 0.15 | 1.0 | 1.5 | 0.01 | 0.003 | 0.03 | — |
| 18 | 0.15 | 1.0 | 1.5 | 0.01 | 0.003 | 0.03 | — |
| 19 | 0.15 | 1.0 | 1.5 | 0.01 | 0.003 | 0.03 | — |
| 20 | 0.15 | 1.0 | 1.5 | 0.01 | 0.003 | 0.03 | — |
| 21 | 0.15 | 1.0 | 1.5 | 0.01 | 0.003 | 0.03 | — |
| 22 | 0.15 | 1.0 | 1.5 | 0.01 | 0.003 | 0.03 | — |
| 23 | 0.15 | 1.0 | 1.5 | 0.01 | 0.003 | 0.03 | — |
| 24 | 0.15 | 1.0 | 1.5 | 0.01 | 0.003 | 0.03 | — |
| 25 | 0.15 | 1.0 | 1.5 | 0.01 | 0.003 | 0.03 | — |

TABLE 3-1

| | | Continuous annealing line (CAL) | | | | | | |
|---|---|---|---|---|---|---|---|---|
| | | Annealing furnace | | | | | Cooling conditions after annealing | |
| Example No. | Presence/absence of cold rolling | Dew point (° C.) | Temperature (° C.) | $H_2$ (%) | log ($H_2O/H_2$) | 2.5[C]-3.5 | Rate of cooling (° C./s) | Temperature after cooling (° C.) |
| 1 | absent | −10 | 900 | 3 | −1.07 | −3.125 | 50 | 250 |
| 2 | present | 0 | 900 | 3 | −0.39 | −3.3 | 50 | 300 |
| 3 | absent | 0 | 900 | 3 | −0.39 | −3.25 | 100 | 200 |
| 4 | present | 0 | 900 | 3 | −0.39 | −3.125 | 50 | 300 |
| 5 | present | 10 | 900 | 3 | −0.39 | −3.125 | 60 | 250 |
| 6 | present | −10 | 900 | 3 | −1.07 | −3.125 | 55 | 250 |
| 7 | present | −5 | 900 | 3 | −0.85 | −3.125 | 45 | 250 |
| 8 | present | 0 | 900 | 3 | −0.39 | −3.125 | 50 | 250 |
| 9 | present | 10 | 900 | 3 | −0.39 | −3.125 | 50 | 300 |
| 10 | present | 0 | 900 | 3 | −0.39 | −3.425 | 50 | 250 |
| 11 | present | 0 | 900 | 3 | −0.39 | −3.125 | 50 | 250 |
| 12 | present | 0 | 900 | 3 | −0.39 | −3.125 | 50 | 250 |
| 13 | present | −30 | 900 | 3 | −1.9 | −3.125 | 50 | 250 |
| 14 | present | −40 | 900 | 3 | −2.36 | −3.125 | 50 | 250 |
| 15 | present | 0 | 900 | 3 | −0.39 | −3.125 | 50 | 250 |
| 16 | present | 0 | 900 | 3 | −0.39 | −3.125 | 50 | 250 |
| 17 | present | 0 | 900 | 3 | −0.39 | −3.125 | 50 | 250 |
| 18 | present | 0 | 900 | 3 | −0.39 | −3.125 | 30 | 400 |
| 19 | present | −60 | 900 | 3 | −3.4 | −3.125 | 50 | 250 |
| 20 | present | 0 | 700 | 3 | −0.39 | −3.125 | 30 | 250 |
| 21 | present | 0 | 900 | 0.5 | 0.081 | −3.125 | 50 | 250 |
| 22 | present | 0 | 900 | 3 | −0.39 | −3.125 | 50 | 250 |
| 23 | present | 0 | 900 | 3 | −0.39 | −3.125 | 50 | 250 |
| 24 | present | 0 | 900 | 3 | −0.39 | −3.125 | 50 | 250 |
| 25 | present | 0 | 900 | 3 | −0.39 | −3.125 | 50 | 250 |

TABLE 3-2

| | Continuous-type hot dip galvanizing line (CGL) | | | | | | | | | |
|---|---|---|---|---|---|---|---|---|---|---|
| | | | | | Hot dip galvanizing bath | | | | | |
| Example No. | Pickling Decrease in the weight of the steel sheet due to pickling (g/m²) | Heat-reduction furnace Temperature (° C.) | Cooling conditions after heat-reduction: Rate of cooling (° C./s) | Cooling conditions after heat-reduction: Temperature after cooling (° C.) | Temperature of the plate when immersed in the galvanizing bath (° C.) | Temperature of the bath (° C.) | Al content (mass %) | Rate at which the plate was moved (m/min) | Heating process for galvannealing: Presence/absence of galvannealing | Heating process for galvannealing: Temperature galvannealing (° C.) |
| 1 | 0.5 | 775 | 20 | 500 | 460 | 460 | 0.13 | 100 | present | 500 |
| 2 | 0.5 | 775 | 20 | 500 | 470 | 460 | 0.13 | 80 | present | 500 |
| 3 | 0.5 | 775 | 20 | 500 | 460 | 460 | 0.13 | 120 | absence | — |
| 4 | 0.5 | 775 | 20 | 500 | 460 | 460 | 0.13 | 100 | present | 500 |
| 5 | 0.5 | 775 | 20 | 500 | 460 | 460 | 0.13 | 100 | present | 500 |
| 6 | 0.5 | 775 | 20 | 500 | 460 | 460 | 0.13 | 100 | present | 500 |
| 7 | 0.5 | 775 | 20 | 500 | 460 | 460 | 0.13 | 100 | present | 500 |
| 8 | 0.5 | 775 | 20 | 500 | 460 | 460 | 0.13 | 100 | present | 500 |
| 9 | 0.5 | 775 | 20 | 500 | 460 | 460 | 0.13 | 100 | present | 500 |
| 10 | 0.5 | 775 | 20 | 500 | 460 | 460 | 0.13 | 100 | present | 500 |
| 11 | 0.5 | 775 | 20 | 500 | 460 | 460 | 0.13 | 100 | present | 500 |
| 12 | 0.5 | 775 | 20 | 500 | 460 | 460 | 0.13 | 100 | present | 500 |
| 13 | 0.5 | 775 | 20 | 500 | 460 | 460 | 0.13 | 100 | present | 500 |
| 14 | 0.5 | 775 | 20 | 500 | 460 | 460 | 0.13 | 100 | present | 500 |
| 15 | 0.5 | 775 | 1 | 500 | 460 | 460 | 0.13 | 100 | present | 600 |
| 16 | 0.5 | 775 | 20 | 500 | 460 | 460 | 0.13 | 100 | present | 560 |
| 17 | 0.5 | 775 | 20 | 500 | 460 | 460 | 0.13 | 100 | present | 500 |
| 18 | 0.5 | 775 | 20 | 500 | 460 | 460 | 0.13 | 100 | present | 500 |
| 19 | 0.5 | 775 | 20 | 500 | 460 | 460 | 0.13 | 100 | present | 500 |
| 20 | 0.5 | 775 | 20 | 500 | 460 | 460 | 0.13 | 100 | present | 560 |
| 21 | 0.5 | 775 | 20 | 500 | 460 | 460 | 0.13 | 100 | present | 500 |
| 22 | 0.04 | 775 | 20 | 500 | 460 | 460 | 0.13 | 100 | present | 500 |
| 23 | 6.0 | 775 | 20 | 500 | 460 | 460 | 0.13 | 100 | present | 500 |
| 24 | 0.5 | 600 | 20 | 500 | 460 | 460 | 0.13 | 100 | present | 500 |
| 25 | 0.5 | 900 | 20 | 500 | 460 | 460 | 0.13 | 100 | present | 500 |

Note) *: Fe converted value

TABLE 4

| Example No. | C content under the coating layer* (mass %) | Fraction of martensite phase (%) | Structure of the remaining portion | Amount of generated oxides** (mass-ppm) |
|---|---|---|---|---|
| 1 | 0.01 | 60 | ferrite + residual austerite | 50 |
| 2 | 0.005 | 60 | ferrite + residual austerite | 50 |
| 3 | 0.005 | 80 | ferrite + residual austerite | 50 |
| 4 | 0.005 | 60 | ferrite + residual austerite | 50 |
| 5 | 0.002 | 75 | ferrite + residual austerite | 50 |
| 6 | 0.01 | 65 | ferrite + residual austerite | 50 |
| 7 | 0.008 | 55 | ferrite + residual austerite | 50 |
| 8 | 0.005 | 60 | ferrite + residual austerite | 50 |
| 9 | 0.002 | 60 | ferrite + residual austerite | 50 |
| 10 | 0.005 | 60 | ferrite + residual austerite | 50 |
| 11 | 0.005 | 60 | ferrite + residual austerite | 50 |
| 12 | 0.005 | 60 | ferrite + residual austerite | 50 |
| 13 | 0.05 | 60 | ferrite + residual austerite | 50 |
| 14 | 0.1 | 60 | ferrite + residual austerite | 50 |
| 15 | 0.005 | 60 | ferrite + pearlite | 50 |
| 16 | 0.005 | 60 | ferrite + bainite | 50 |
| 17 | 0.005 | 60 | ferrite + residual austerite | 50 |
| 18 | 0.005 | 35 | ferrite + residual austerite | 50 |
| 19 | 0.1 | 60 | ferrite + residual austerite | 0.5 |
| 20 | 0.05 | 35 | ferrite + bainite | 0.5 |
| 21 | 0.005 | 60 | ferrite + residual austerite | 50 |
| 22 | 0.005 | 60 | ferrite + residual austerite | 50 |
| 23 | 0.14 | 60 | ferrite + residual austerite | 0.5 |
| 24 | 0.005 | 60 | ferrite + residual austerite | 50 |
| 25 | 0.005 | 60 | ferrite + residual austerite | 50 |

| Example No. | Fe content in the plating layer*** (mass %) | Evaluation of mechanical property | Evaluation of plating adhesion property | Note |
|---|---|---|---|---|
| 1 | 10.1 | excellent | 2 | example according to the present invention |
| 2 | 10.3 | excellent | 2 | example according to the present invention |
| 3 | 1.09 | excellent | 1 | example according to the present invention |
| 4 | 9.5 | excellent | 2 | example according to the present invention |
| 5 | 10.3 | excellent | 2 | example according to the present invention |
| 6 | 11.5 | excellent | 2 | example according to the present invention |
| 7 | 11.0 | excellent | 2 | example according to the present invention |
| 8 | 8.9 | excellent | 2 | example according to the present invention |
| 9 | 9.9 | excellent | 1 | example according to the present invention |
| 10 | 9.9 | poor | 1 | comparative example |
| 11 | 10.5 | excellent | 5 | comparative example |
| 12 | 10.3 | poor | 1 | comparative example |
| 13 | 11.1 | excellent | 5 | comparative example |
| 14 | 9.4 | excellent | 5 | comparative example |
| 15 | 9.8 | poor | 1 | comparative example |
| 16 | 10.1 | poor | 1 | comparative example |
| 17 | 13.5 | excellent | 5 | comparative example |
| 18 | 10.6 | poor | 1 | comparative example |
| 19 | 10.4 | excellent | 5 | comparative example |
| 20 | 10.2 | poor | 5 | comparative example |
| 21 | 10.4 | excellent | 5 | comparative example |
| 22 | 10.9 | excellent | 5 | comparative example |
| 23 | 9.5 | excellent | 5 | comparative example |
| 24 | 9.4 | excellent | 5 | comparatiev example |
| 25 | 9.8 | excellent | 5 | comparative example |

Note)

*The C content at the base steel surface layer portion right under the coating layer

**The value obtained by converting, the amount of oxides generated at the base steel surface layer portion, into the amount of oxygen

***In the case of the hot dip galvanized steel sheet which has been subjected to the galvannealing, the Fe content in the coating layer after the galvannealing is shown.

Industrial Applicability

According to the present invention, a hot dip galvanized steel sheet having excellent balance between tensile strength and ductility and excellent coating adhesion can be obtained.

In addition, by applying the hot dip galvanizing steel sheet of the present invention, automobiles can be made lighter and the energy consumption rate thereof can be decreased, whereby a significant contribution can be made to improvement of the global environment.

What is claimed is:

1. A hot dip Zn galvanized steel sheet having excellent balance between tensile strength and ductility and excellent coating adhesion, an average composition of a base steel thereof comprising:

0.05–0.25 mass % of C;

not more than 2.0 mass % of Si;

1.0–2.5 mass % of Mn; and 0.005–0.10 mass % of Al, wherein the C content at the base steel surface layer portion right under a coating layer is not more than 0.02 mass %, the base steel structure contains martensite phase, by not less than 50% as a fraction, the martensite phase including both tempered martensite phase and fine size martensite phase, and the remaining portion of the base steel structure being formed by ferrite phase and residual austenite phase.

2. A hot dip Zn galvanized steel sheet having excellent balance between tensile strength and ductility and excellent coating adhesion of claim 1, wherein at least one type of oxide selected from the group consisting of Si oxides, Mn oxides, Fe oxides and composite oxides thereof is present, in at least one of grain boundary and crystal grain of a region in which the C content is not more than 0.02 mass % of the base steel surface layer portion right under the coating layer, and the amount of oxides generated at the base steel surface layer portion, when it is converted into the amount of oxygen, is 1–200 mass-ppm.

3. A hot dip Zn galvanized steel sheet having excellent balance between tensile strength and ductility and excellent coating adhesion of claim 1, wherein the Fe content of the coating layer is in the range of 8–12 mass %.

4. A method of producing a hot dip Zn galvanized steel sheet having excellent balance between tensile strength and ductility and excellent coating adhesion, comprising the steps of:

preparing hot-rolled steel sheet or cold-rolled steel sheet having a steel sheet average composition which includes: 0.05–0.25 mass % of C; not more than 2.0 mass % Si; 1.0–2.5 mass % of Mn; and 0.005–0.10 mass % of Al;

heating the hot-rolled steel sheet or cold-rolled steel sheet in an atmosphere which satisfies the following formula at a temperature of 800–1000° C.:

$$\log(H_2O/H_2) \geqq 2.5[C]-3.5$$

wherein $H_2O/H_2$ represents the ratio of the partial pressure of moisture in the atmosphere with respect to the partial pressure of hydrogen gas, and [C] represents the amount of C in the steel (mass %);

cooling the hot-rolled steel sheet or cold-rolled steel sheet;

pickling the surface of the steel sheet, so that a decrease in the weight of the steel sheet due to pickling, when it is expressed as a Fe converted value, is 0.05–5 $g/m^2$;

heating the steel sheet again in a continuous-type hot dip Zn galvanizing line to a temperature of 700–850° C.; and subjecting the steel sheet to a hot dip Zn galvanizing process.

5. A method of producing a hot dip Zn galvanized steel sheet having excellent balance between tensile strength and ductility and excellent coating adhesion of claim 4, further comprising the step of subjecting the steel sheet to galvannealing at a temperature of 450–550° C. after completing the hot dip Zn galvanizing process.

* * * * *